US007574876B2

(12) United States Patent
Goldschmidt

(10) Patent No.: US 7,574,876 B2
(45) Date of Patent: Aug. 18, 2009

(54) ILLUMINATED KNITTING DEVICE

(76) Inventor: Pamela Goldschmidt, Jenny Close, Mamaroneck, NY (US) 10543

( * ) Notice: Subject to any disclaimer, the term of this patent is extended or adjusted under 35 U.S.C. 154(b) by 288 days.

(21) Appl. No.: 11/549,290

(22) Filed: Oct. 13, 2006

(65) Prior Publication Data

US 2007/0151299 A1 Jul. 5, 2007

Related U.S. Application Data

(60) Provisional application No. 60/747,316, filed on May 16, 2006, provisional application No. 60/756,617, filed on Jan. 5, 2006.

(51) Int. Cl.
*D04B 3/02* (2006.01)

(52) U.S. Cl. ..... 66/118; 66/117; 66/1 A

(58) Field of Classification Search ..... 66/116, 66/117, 118, 178 R, 179, 180, 181, 182, 183, 66/184, 185; 362/119, 120, 555
See application file for complete search history.

(56) References Cited

U.S. PATENT DOCUMENTS

| | | | | |
|---|---|---|---|---|
| 1,327,918 | A | 1/1920 | Kelsey | |
| 2,341,403 | A * | 2/1944 | Williams | 66/117 |
| 2,344,370 | A * | 3/1944 | Shapiro | 66/117 |
| 2,378,544 | A * | 6/1945 | Fosse et al. | 66/117 |
| 2,748,582 | A * | 6/1956 | Hadler | 66/117 |
| 3,384,220 | A * | 5/1968 | Linstead | 206/574 |
| 4,341,094 | A | 7/1982 | Heide | |
| 4,680,947 | A | 7/1987 | Phipps, Sr. et al. | |
| 4,846,351 | A * | 7/1989 | Gardiner | 206/574 |
| 4,884,619 | A | 12/1989 | Miyamura | |
| 5,152,598 | A * | 10/1992 | Schaffer | 362/577 |
| 6,325,522 | B1 * | 12/2001 | Walian | 362/119 |
| 6,520,389 | B1 | 2/2003 | Bowman | |
| 6,862,764 | B2 * | 3/2005 | Ping | 7/128 |
| 7,114,354 | B1 * | 10/2006 | Dremann | 66/118 |

OTHER PUBLICATIONS

Article in New York Times, "Knitting in the Dark" Apr. 23, 2006 by Susan Guerrero & header package (1 page).
Needle Lite—The Light Aided Knitting Needles, image of header card & specimen (1 page).
Fun-Tastick Battery Operated L.E.D. Glo Lite, package photo copy (1 page).

* cited by examiner

*Primary Examiner*—Danny Worrell
(74) *Attorney, Agent, or Firm*—Lackenbach Siegel, LLP; Andrew F. Young

(57) ABSTRACT

The present invention involves an illuminated knitting and crochet device in the form of a hand tool easily sold as a kit with variety of sizes. A partial or full-length bounded inner region contains one or more light emitting devices, optionally actuated by a power supply source and a switch. In one embodiment a solid translucent or transparent tip is provided with a hollow needle body. In an alternative embodiment a computer control module may be optionally inserted to enable a non-use or non-motion automatic turnoff of the device thereby conserving energy for later reuse. As a consequence of the present invention those of skill in the knitting arts may freely operate within a low light or a no light knitting environment with relative ease, thereby improving knitting enjoyment.

1 Claim, 6 Drawing Sheets

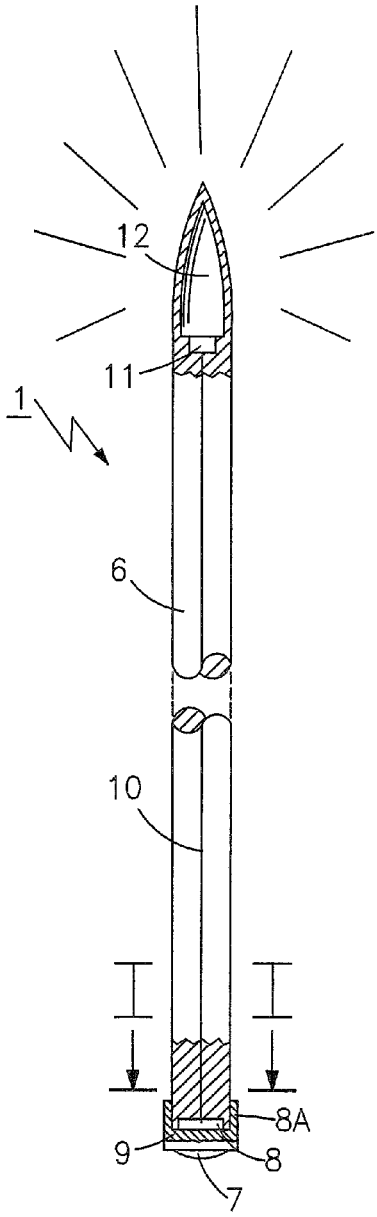
FIG.1
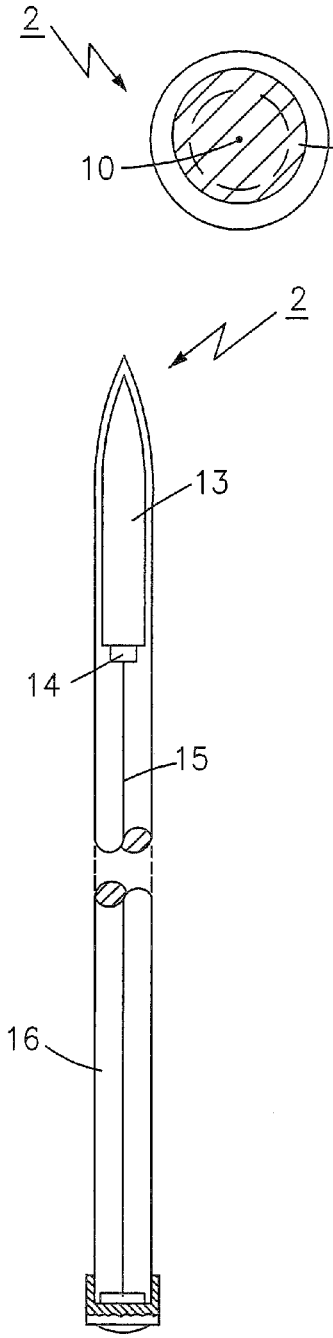
FIG.4
FIG.2
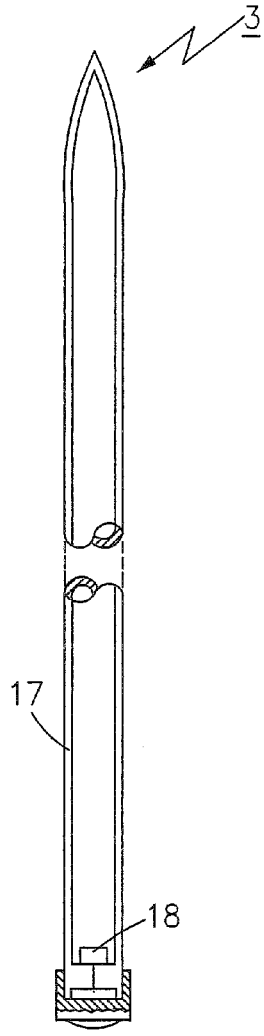
FIG.3

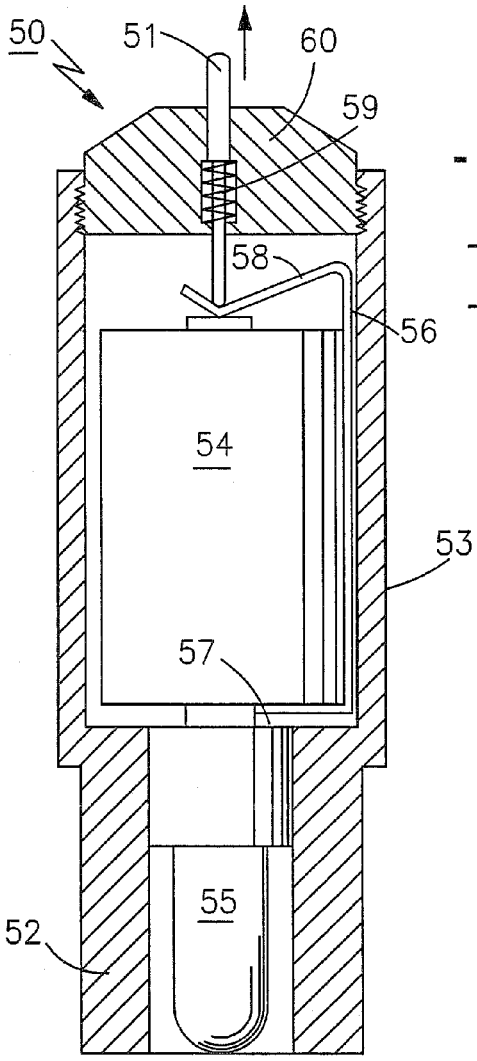
FIG. 7
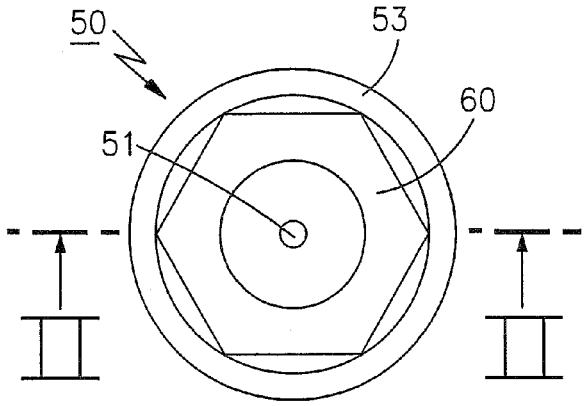
FIG. 8
FIG. 9
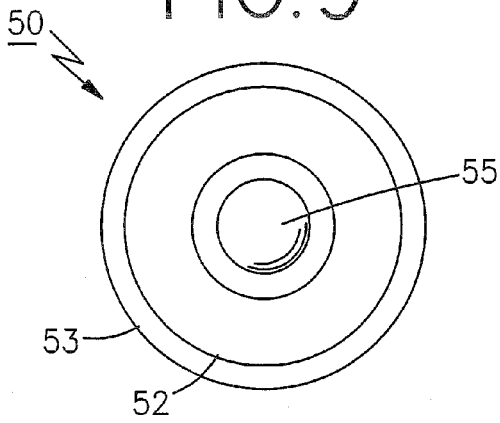

ILLUMINATED KNITTING DEVICE

CROSS REFERENCE TO RELATED APPLICATIONS

This application priority to and incorporates by reference the disclosures, in their entireties, of U.S. Provisional Patent Application Ser. Nos. 60/756,617 filed on Jan. 5, 2006 and 60/747,316 filed on May 16, 2006.

BACKGROUND OF THE INVENTION

1. Field of the Invention

The present invention relates to an illuminated knitting needle or crochet hook. More specifically, the present invention relates to a knitting or crochet device containing a light emitting diode (L.E.D.), a power source and a switch mechanism for projecting illuminating light along an internal transmission medium.

2. Description of the Related Art

The related art involves a series of illuminated tool handles wherein a tool handle itself often contains the lighted bulb, the handle receives removable hand tools (such as screw-driver bits), and the handle includes a lens for directing the bulb light onto the end of a tool head positioned externally to the handle. It has been known previously from U.S. Pat. No. 2,344,370 to Shapiro and U.S. Pat. No. 6,325,522 to Wilian (the contents of each of which are fully incorporated) that knitting needles may be illuminated by a bulb, a solid body of Lucite or the like and are generally limited to projecting illuminating light forwardly.

U.S. Pat. No. 6,325,522 to Wilian provides a tool holder and has a battery, bulb and switch in the mounting handle but is otherwise unlike the present invention.

Applicant is also now aware of an illuminated knitting needle crafted by La Knitterie Parisienne identified as "Knit Lite™" located at www.laknitterieparisienne.com and published in the New York Times on Sunday Apr. 23, 2006, Style Page 3, but has no information related to timing of a first public disclosure relevant to Applicant's earlier provisional application Ser. Nos. 60/756,617 filed Jan. 5, 2006, and 60/747,316 filed May 16, 2006 or Applicant's earlier date of invention, and thus this description herein cannot be and is not an assertion of a prior art status for this item. This description is provided here for the best available contrast with the present invention. As shown online, the La Knitterie devices include a transparent tip region, and opaque body, and a fixed battery pack projecting from the end of each needle both axially (away from the center shaft line), and longitudinally (in a direction along the center line). Operation and other functionality are not known at this time. These needles are constructed in pairs and sold in size-pairs.

What is not appreciated by the prior art is the need for a very lightweight design that enables both solid and substantially hollow knitting needle, one enabling a user to use the needle in a reliable manner, for a long period of time, such that hand fatigue is eliminated or substantially reduced.

What is also not appreciated by the prior art is the need for an illuminated knitting needle that has an illuminated shaft allowing ready stitch-counting in low-light situations and improving stitch-counting in normal lighting situations. What is also not appreciated by the prior art is that the illumination, or number of lumens per unit area provided by the device should be carefully regulatable or adjustable, depending upon the circumstances where use may occur under varied ambient light condition.

For example, no prior art is provided that enables an adjustable feature allowing an adjustable amount of light to be illuminated depending upon a relative darkness of an area or with a preferred illumination pattern. Also not provided in the previous art is an illuminated knitting needle having a switched motion sensor for turning off the device upon a suitable period of disuse. The previous art similarly fails to appreciate the need for a variable power outlet, a convenient and substantially uniform body circumference, and particularly a device wherein the balance of weight is centered along the length of the device itself and not solely in a shaft-end battery pack. Such uniformity of gravity or of weight provides an improved balance and an improved hand feel of a knitting needle allowing the user to operate the device for long hours.

What is also not appreciated by the prior art is the need for a readily transferable battery and switch pack between needles thereby allowing a substantial cost reduction in a competitive market place. Finally what is not appreciated is the need for, and convenience of, selling a comprehensive or competitive set of needle size-pairs with a pair of functional battery units, in a kit allowing a user to purchase one low-cost kit to achieve the utility of an entire series of illuminated needles without the cost.

Accordingly there is a need for an improved illuminated knitting needle or crochet device that responds to at least one of the needs noted above.

OBJECTS AND SUMMARY OF THE INVENTION

An object of the present invention is to provide an illuminated knitting needle or crochet hook that responds to at least one of the needs noted above.

Another object of the present invention is to provide an illuminated device containing at least one L.E.D. (light emitting diode) or other light-emitting device actuated by a user switch and powered by a small sized power supply.

Another object of the present invention is to provide an illuminated knitting device having a translucent or transparent structure enabling the use of at least one internally positioned light emitting diode (L.E.D.) to transmit light through the material of the device, or optionally through an open light chamber, or both simultaneously.

Another object of the present invention is to provide an illuminated knitting device that increases a user's convenience during the knitting-learning process where detailed tracking of the shaft tips by eye in low-light conditions is difficult.

Another object of the present invention is to provide an illuminated knitting device that enables new users to readily learn the knitting process in low illumination or uneven illumination conditions, such as an automobile or a performance theatre.

A further object of the present invention is to provide an illuminated knitting hand device having capacity for variable power light output, whereby the device enables an adjustment of the lumen output based upon a user's selection, or optionally upon a determination by an internal light sensor of a need for light.

Another object of the present invention is to provide an end-positioned snap-on switch for user convenience thereby allowing the useful shaft length to be substantially free of perturbations to allow stitches to slide easily off during knitting or to allow the ready accumulation of stitches along substantially the entire length of the device.

Another object of the present invention is to provide an illuminated knitting device that is easily crafted to emit differing wavelengths (colors) depending upon a pre-selected size of needle, or vary wavelength based on position along a length of the device.

Another object of the present invention is to provide an illuminated knitting tool having a generally uniform external diameter without substantial perturbations or weight irregularity. Tied to this object is a preference to select a design that enables ready modification or adjustment of internal weight and hence balance point along a length without changing an external shape and without detracting from the operation and output illumination of the device.

Another object of the present invention is to provide an illuminated knitting device having a plurality of L.E.D.'s positioned longitudinally along an internal open body length whereby said L.E.D.'s may output a similar or substantial uniform quantity of light, or be adjustably actuated to output variable light amounts depending upon either a distance from a source, a desired entertainment value, or the need for an intense light appropriate to a tip of the device for specific use in extreme low light conditions.

Another object of the present invention is to provide a lighted hand tool including an internal light reflection chamber allowing light emitted from a point source (LED) to be multiply reflected and internally distributed before exiting the device.

Another object of the present invention is to provide an operational pack (battery, switch, and light source) that is readily transferred between different needle sizes.

Another object of the present invention is to provide an illuminated needle that is simply, readily, and reliably illuminated along its entire length by a single lighting source in combination with a re-position-able power source and switch in a complete kit assembly.

Another object of the invention is to provide a kit for storing and carrying groups each of a like number and type illuminated needles in a tray wherein the needles are removably retained in clip members, the tray being fitted with a removable—remountable cover specially adapting the kit for vending purpose as well as for user storing and carrying the needles.

The present invention relates to an illuminated knitting device or an illuminated knitting or crochet device including a supporting member, a plurality of light emitting diodes, an operable power supply, a switch mechanism and optionally controlling software and memory functions enabling adjustment of a light output depending upon the use condition.

According to an embodiment of the present invention there is provided a light emitting device comprising a light emitting system having a support member, a power generation system, a switch mechanism for controlling an operation of said power system and said light emitting system, wherein the supporting member includes at least a first hollow member for transmitting light illuminated by an illuminating means for enhancing the user convenience.

According to another embodiment of the present invention, there is proposed a simplified construction containing a solid translucent tip member that is translucently sealed to a transparent shaft member in such manner as it does not prohibit lighting of the knitting tip or crocheting tip end by a distally located light emitting source.

Another embodiment of the invention provides a kit containing at least two groups of knitting devices, each group having the same number and type of knitting devices as the other group. The groups are carried in a tray having a cover. Two power units containing, a light emitting member for illuminating the knitting devices when in use, a switch means to selectively controlling lighting function, a connector connecting a battery and the light emitting member are provided in the tray, the power units being removably mountable to each of the knitting device.

The above, and other objects, features and advantages of the present invention will become apparent from the following description read in conduction with the accompanying drawings, in which like reference numerals designate the same elements.

BRIEF DESCRIPTION OF THE DRAWINGS

FIG. 1 is a partially cut-away view of an illuminated knitting device according to one aspect of the present invention.

FIG. 2 is a longitudinal partial cross-section view of a second alternative embodiment of an illuminated knitting device according to another aspect of the present invention.

FIG. 3 is a longitudinal partial cross-section view of a third alternative embodiment of an illuminated knitting device according to another aspect of the present invention.

FIG. 4 is a cross-sectional end view along lines I-I of FIG. 1.

FIG. 7 is a cross-sectional view of an illumination assembly according to one aspect of the present invention along line II-II in FIG. 8.

FIG. 8 is a switch-end view of the FIG. 7 illumination assembly.

FIG. 9 is a front-end view of the illumination assembly shown in FIGS. 7, 8.

DETAILED DESCRIPTION OF THE PREFERRED EMBODIMENTS

Figure 5:
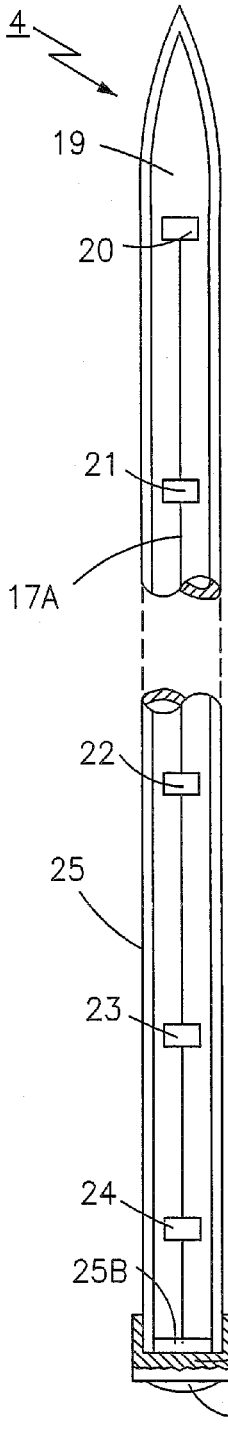
FIG. 5 is a longitudinal partial cross-sectional view of a fourth alternative embodiment of an illuminated knitting device having a multi-light output system as a series of light emitting sources.

Referring now to FIGS. 1 and 4, a first embodiment of an illuminated knitting tool 1 includes an extending shaft member 6 projecting from an end cap 8A containing a switch 7 and, optionally a computer control module 9 and an internal power source 8.

A wire 10 extends from optionally computer control module 9 and always from power source 8 along shaft 6 until reaching an illumination device 11 commonly referred to as a light emitting device (L.E.D.) formed at a base of an internal reflection and illumination cavity 12 within a tip of device 1. During operation of the present embodiment, switch 7 is actuated and completes a power circuit via power source 8 and computer control module 9 to wire conduit 10 thereby energizing light emitting device 11 to project upwardly into light reflection and illumination area 12 at the knitting tip end of tool or needle 1, and thereby illuminating the tip end of device 1. It is noted that where unnecessary based upon manufacturing specification, computer control module 9 may be excluded from the product without harming the essential objectives noted herein, thereby allowing device 1 to operate solely with switch 7.

As should be optionally understood throughout this present disclosure, the shaft material may be selected from any acceptable material presently known to those within the knitting arts. These suitable include, but are not limited to opaque, transparent and translucent materials. These materials also include natural (for example, wood or material) and man-made material (plastic, ceramic, carbon fiber) or combination thereof.

As a consequence of the present invention, it is envisioned that a bounding translucent or transparent material allowing outward transmission of lumens from light source 11 defines reflection and illumination area 12 and allows ready radial distribution of light from point source LED 11.

Referring now to FIG. 2, an alternative embodiment of an illuminated knitting device 2 includes a shaft 16 housing a wire conduit 15 providing power to an illumination source 14 (preferably a L.E.D. source) within a base of a reflection and dispersion area 13 at a tip of device 2.

In the present embodiment, shaft 16 is constructed from one of a translucent and transparent material, for example, plastic, lexan, fiberglass, or a ceramic composition such as quartz, glass, or alumina. During operation, as light is emitted from light emitting device 14 (L.E.D.) light is transmitted from device 14 upwardly into reflection area 13 which is open and allows ready reflection from internal surfaces thereby promoting a visual appearance of glowing at the tip of device 2. Such glowing allows ready eye-tracking of the tip end of shaft 16 during knitting and minimizes eye fatigue by minimizing sharp point-light sources. It should be recognized by those of skill in the art that the internal or external surfaces of reflection area 13 may be modified by a filter to adjust wavelength, reflectance, and other optical characteristics.

Referring now to FIG. 3 wherein alternative embodiment 3 of the present invention includes a light emitting device 18 at a base of an extended light transmission cavity 17 bounded by a transparent or translucent shell 17A forming the shaft. During operation device 3 is similar to those noted earlier but is extended in view whereby an entire length of shaft shell 17A is illuminated as opposed to alternative embodiment 2 wherein a tip is preferably illuminated and shaft 16, even where transparent or translucent, is only partially illuminated.

It will be understood that in the various embodiments described above and below, effective illumination of the knitting device tip end as well as along other locations along a device, it is required to have unobstructed illumination communication between a light source and the structure part to be illuminated. This can be achieved by disposing the light source directly at a cavity or bore defining or leading to the surface to be illuminated or, by interposing a solid light transmissive member such as rod extending from the light source to the surface to be illuminated at the light source and such as a rod One benefit of the present embodiment, is that the inner surface of transmission cavity 17 may be optionally coated by a reflecting material, such as silver or aluminum, in whole or part. As a consequence, optional illumination patterns may be employed, allowing for example full illumination at a shaft tip, but only partial illumination at a base of the shaft, or wavelengths of light may be filtered out by a CVD (chemical vapor deposition) type optical filter. Further, directional lines or alignment notes maybe provided along a length of the shaft to further aid a user with only a beginning knowledge of knitting.

Referring now to FIG. 5, an alternative embodiment of an illuminated knitting device at 4 includes a plurality of light emitting devices 20, 21, 22, 23, and 24, strung along a length of power transmitting and optionally instruction transmitting wire 19A along a shaft 25 of device 4. As shown, shaft 25 is similar to shaft 17A shown within FIG. 3, and encircles a bounded light reflection and transmission region 19 region within the shaft. As a consequence, as noted in FIG. 3, shaft 25 provides a bounded shell around region 19 wherein light emitting devices 20 through 24 are positioned by adhesive or fixture points (both not shown) to prohibit unintended movement relative to the base or the tip of shaft 25. As noted, lighting emitting devices 20 through 24 emit light along an entire length of shaft 25 and provide for high intensity light output as will be further described via computer controlled power supply. Within embodiment 4, a computer control module 25A adjacent power supply source 25B is actuatable via switch control mechanism 25C.

It is envisioned in the present embodiment, that switch mechanism 25C and computer control module 25A enable a complete control of light emitting devices 20 through 24, whereby an individual light output may be adjusted, a variable power may be supplied to the light emitting devices thereby allowing the lights to dim or brighten upon command, and a selective timing element or motion sensor (within computer control module 25A) may enable device 4 to be turned off following a period of timed non-use or a period of non-motion use. It is therefore envisioned by the present invention that the knitting needles may turn themselves off to conserve energy during periods of non-use triggered by a motion sensor or by a timing device.

Figure 5A:
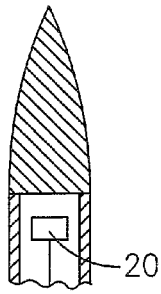
FIG. 5A is a partially formed cross-sectional tip view of a fifth alternative embodiment wherein a translucent and solid tip member is fixably positioned on an end of a hollow shaft member.

FIG. 5A depicts another embodiment in which shaft 25 is a separate tubular member to which is affixed a solid transparent or translucent tip end member.

Figure 6:
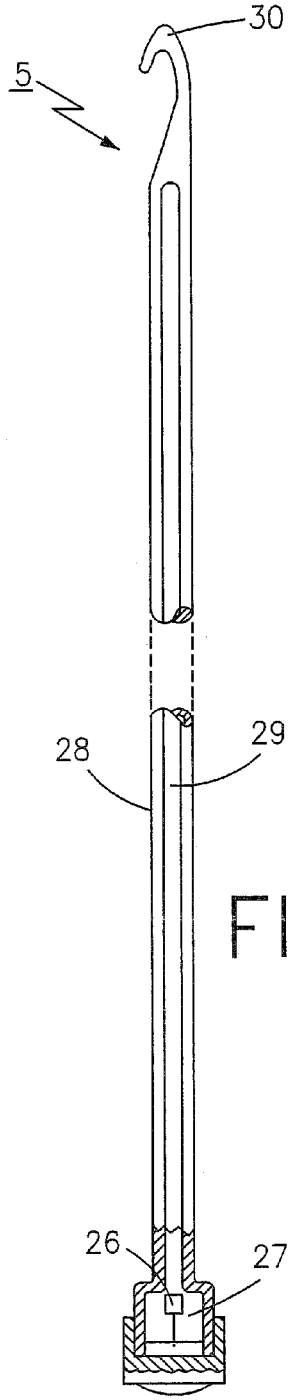
FIG. 6 is a longitudinal cross-sectional view of a fifth alternative embodiment of an illuminated knitting device wherein a crochet knitting device includes a light emitting device at a tail end of an expansive light chamber extending substantially the length of the device but for a section at the knitting or crocheting opposite tip end of the device.
Figure 10:
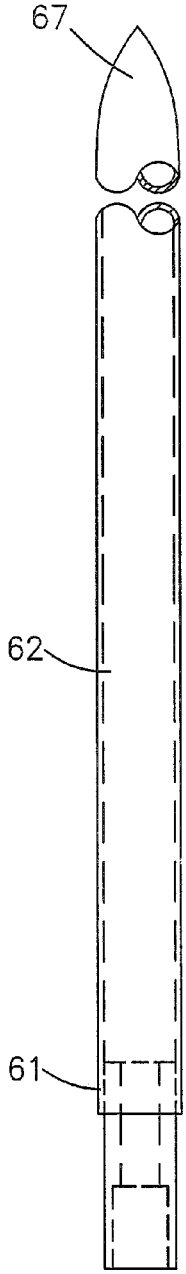
FIG. 10 is a side view of an illuminated knitting needle having a large size, assembled with the illumination assembly.
Figure 11:
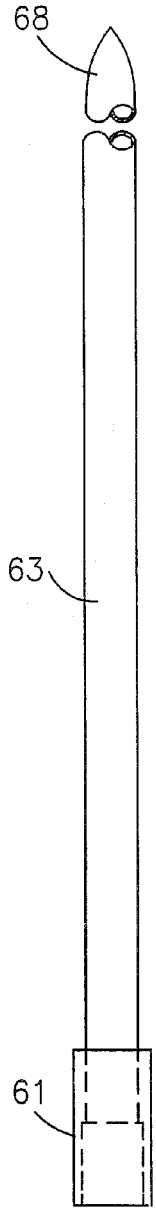
FIG. 11 is a side view of an illuminated knitting needle having a size less than FIG. 10, without the illumination assembly.
Figure 12:
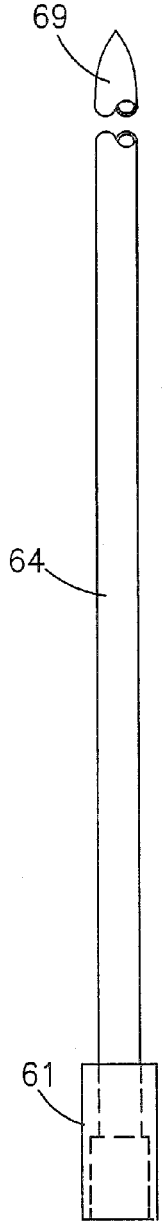
FIG. 12 is a side view of an illuminated knitting needle having a size less than FIG. 11, without the illumination assembly.
Figure 13:
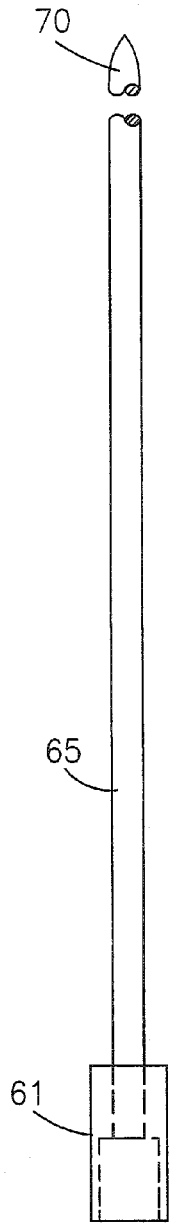
FIG. 13 is a side view of an illuminated knitting needle having a size less than FIG. 12, without the illumination assembly.

Referring now to FIG. 6 wherein an alternative embodiment of an illuminated crochet hook 5 includes a light emitting device 26 housed within a reflection and illumination chamber 27 communicating with an extending internal light reflecting chamber 29 housed within a hollow shaft 28 joining light emitting device 26 to a device tip end crochet hook 30.

In the present alternative embodiment, those who are skilled in the art will readily recognize that any of the previous design elements discussed within FIGS. 1 through 5 may be readily adapted to the crochet hook embodiment 5 shown in FIG. 6 without departing from the spirit and scope of the present invention.

While the present hook embodiment 5 is shown with a lower diameter profile for use with smaller sized crochet fibers those of skill in the design arts will readily recognize that the earlier teachings above may be employed without departing from the invention. Thus, it is envisioned that a plurality of light emitting devices 26 may be positioned along an internal length of reflecting chamber 29 to allow varied light supply along a working length of crochet hook 5.

Those of skill in the art will also recognize that the present invention may be adapted to additionally include light or motion sensors, and optionally a timing mechanism, either with or proximate to the computer control module. Such sensors would increase the utility, safety, and convenience of the device and allow for battery conservation during periods of non-use.

Additionally, with the inclusion of such sensors, including motion sensors, a user may greatly increase convenience, by adjusting the light output along an entire shaft, or along a selected portion of the shaft, or to select a preferred illumination setting (low at the base and high illumination at the tip, etc.) Obviously, such adaptability provides substantial utility to those with only limited eyesight or other visual difficulty.

Referring now to FIGS. 7-9, one embodiment of an illumination assembly 50 includes an actuation switch 51 opposite a light emitting diode (L.E.D.) unit 55 on a male engagement socket end 52 having a diameter less than a diameter of a main barrel section 53 sized to contain a battery unit 54. It should be understood, that light emitting diode unit 55 may include one or more LED's depending upon a manufacturer's desired construction.

A spring and contact engagement member 56 includes a first contact member 57 for operatively and electrically connecting battery unit 54 with light emitting diode unit 55. A second contact member 58 is a spring arm that urges connection with battery unit 54 during assembly. A spring member 59 in end cap member 60 urges actuation switch 51 away from contact member 58 during non-use to prevent unintended actuation and a securing mechanism (a common electrical click-switch, not shown) enables secure electrical engagement, via switch 51, of battery unit 54 and operation of light emitting diode unit 55.

As will be understood from further review, the diameter of male socket end 52 is sized to be received in a respective universal female socket end 61 unit positioned on an end of each respective needle member.

Figure 14:
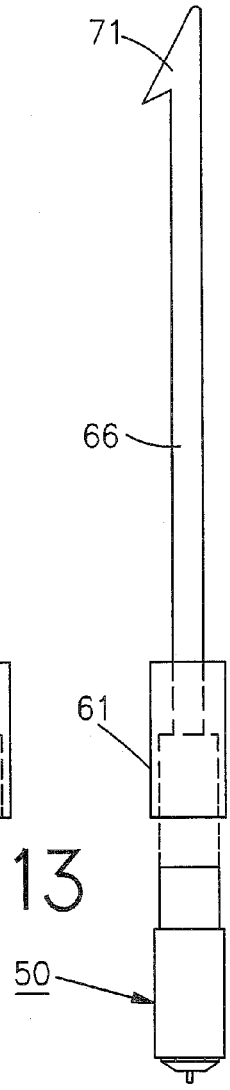
FIG. 14 is a side view of an illuminated crochet knitting needle having a size less than FIG. 13 with a crochet-tip and an associated illumination assembly.

Referring now to FIGS. 10-13, a plurality of differently sized needle members are shown, 62, 63, 64, 65, and 66, each having a respective universal female socket end unit 61 positioned opposite respectively sized end tip (knitting and or crochet) members 67, 68, 69, 70, and 71, the last-mentioned needle member being configured with a crochet hook, rendering member 71 a knitting device different as to type with members 67-70 which are knitting needles. It is to be understood, that each needle member is formed substantially from a transparent or translucent material (glass, lexan, poly, etc.) and is either substantially hollow (See FIG. 10) or substantially solid (See FIG. 14). Thus, those of skill in the art will recognize that FIG. 14 may include a substantially hollow needle shaft 66 similar to the shaft 62 of FIG. 10 terminating in a solid crochet hook knitting tip end 71, and vice versa without departing from the scope and spirit of the present invention.

In each respective needle, female socket unit 61 is firmly joined with each respective needle member 62-66 opposite tips 67-71 for interchangeably and securely receiving illumination assemblies 50 during use.

As will be noted from each figure, outer diameter of male member 52 securely seats with friction within female socket unit 61 preventing unintended removal. While this construction is selected for convenience, alternative securing and removal systems are envisioned without departing from the scope of the present invention. These include snap-detent systems, threadably engagable systems, magnetic engagement systems, slot-key engagement systems and other systems know to those of skill in the art for similar circumstances.

While not shown in the present invention, it is additionally contemplated, that inner surfaces of needle members 62-66 may be selectively coated with transparent, translucent, or opaque films depending upon a consumer and manufacturer desire.

Figure 15:
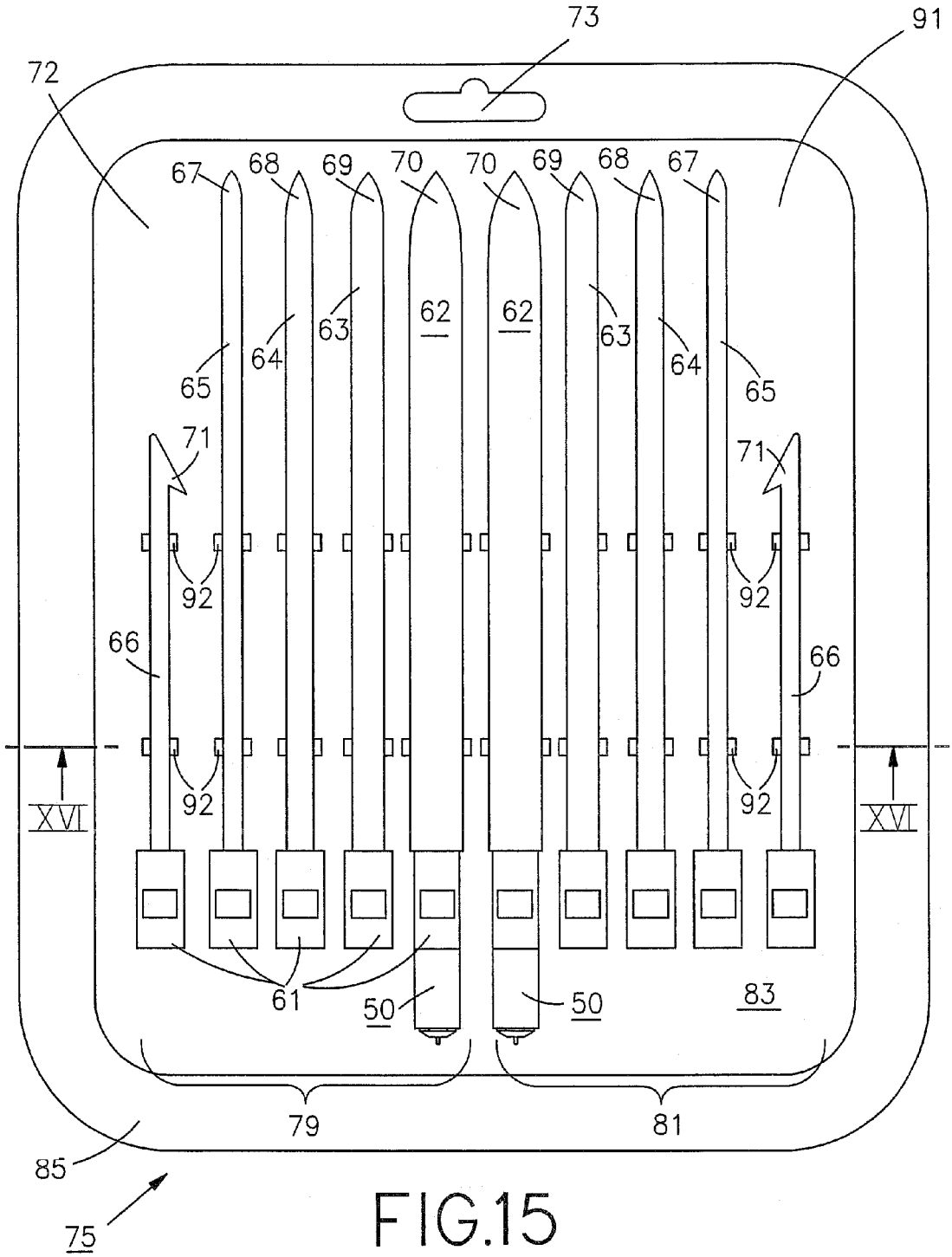
FIG. 15 is a front view of a kit wherein a plurality of differently sized knitting and crocheting needles along with several illumination assemblies removably and interchangeably mountable to the needles are provided.
Figure 16:
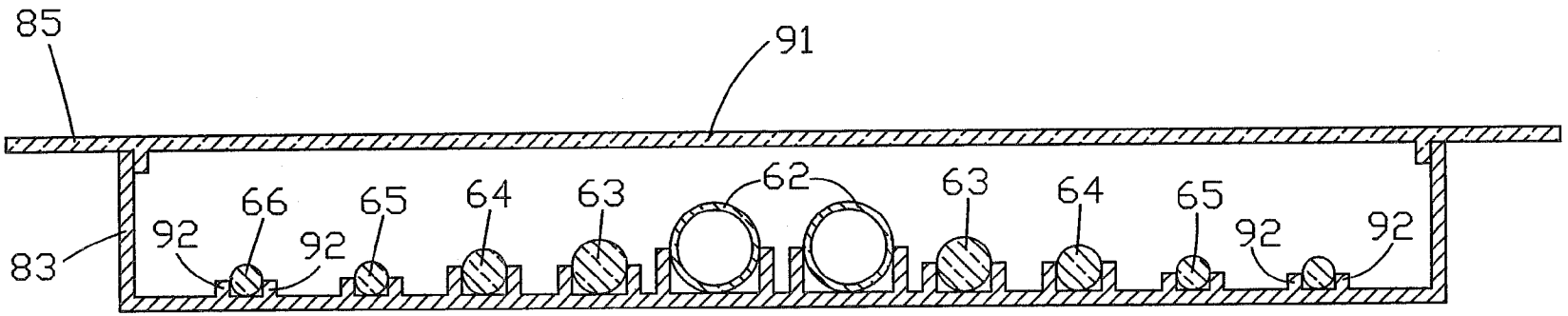
FIG. 16 is a section view taken on the line XVI-XVI in FIG. 15.

Referring now to FIGS. 15 and 16, a kit 75 includes a plurality of needle unit members 62-66 each with respective female members 61 secured within a blister type, transparent face housing 72 which can be a sealed blister type package, (FIG. 15) or it can be a reusable tray 83 having a reusable cover 85 (FIG. 16). Cover 83 is provided with a flange part that defines a frame for a transparent cover portion 91. The package can have having an opening 73 for holding the unit on a point of purchase display rack. In the present kit 75, only two interchangeable illumination units 50 are provided but are sufficient for a user to employ the complete set of needles by simply interchanging units 50 depending upon a needle size selection. Spring retainers or clips 91 are provided in the tray 83 for holding the knitting devices securely in place in the tray.

As shown in FIG. 15, the kit contains at least two groups 79, 81 of knitting devices 62-65 the devices in a group being arranged in side—by side array one with each others in the group. The knitting devices in each group differ as to others in the group both as to size and type. Thus, devices 62-64 are knitting needles wherein the needle size varies from largest 62 to smallest 64. Device 65 it is noted is one fitted with a crochet hook 87. The arrays of the groups 79 and 81 disposed in tray 83 along side each other with a largest size knitting device 62 in one group being located proximally adjacent spaced with a largest sized knitting device 62 in the second group. The other knitting different size knitting devices 63-65 in each group are spaced in order of lessening size correspondingly more distally the group largest size knitting device 62. The crochet hook type 66 in a group is positioned more distally of the group largest size knitting device 62 than any remaining size type knitting device 63-65.

As a consequence, those of skill in the art should readily recognize the substantial user convenience provided by the present design as well as the ready manufacturing adaptability allowing manufacturers to select and populate kit sizes depending upon market need.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled. in the art without departing from the scope or spirit of the invention as defined in the appended claims.

What is claimed is:

1. A knitting device comprising:

a needle having an elongate body extending between a body knitting tip end and a body opposite end, at least a length portion of said body extending a distance from said knitting tip end toward said opposite end being light transmissive;

a light emitting member carried in said body and having illumination communication with said body length portion, a source of power carried on said body for supplying operating power to said light emitting member;

means for connecting said source of power with said light emitting member;

switch means for controlling delivery of operating power to said light emitting member whereby on a delivery of operating power said light emitting member communicates light to said body length portion for illuminating said body length;

said light emitting member, said source of power, said connecting means and said switch means are embodied together in a power unit removably receivable on said body opposite end; and said power unit being interchangeably mountable on each of a plural of like devices having an elongate body diameter different than an elongate body diameter of each of other ones in said plurality.

* * * * *